United States Patent [19]

Lees et al.

[11] Patent Number: 4,725,371

[45] Date of Patent: Feb. 16, 1988

[54] PARTIALLY ORIENTED POLYESTER YARN EMULSION FINISH WITH ELEVATED PH

[75] Inventors: Gerard Lees; Ronald L. Griffith, both of Charlotte, N.C.

[73] Assignee: Celanese Corporation, New York, N.Y.

[21] Appl. No.: 695,988

[22] Filed: Jan. 29, 1985

[51] Int. Cl.[4] ..... D06M 11/00

[52] U.S. Cl. ..... 252/8.9; 252/8.6

[58] Field of Search ..... 252/8.6, 8.9

[56] References Cited

U.S. PATENT DOCUMENTS

| | | | |
|---|---|---|---|
| 3,248,258 | 4/1966 | Coats, Jr. | 428/395 |
| 3,575,856 | 4/1971 | Anton | 252/8.9 |
| 3,887,497 | 6/1975 | Ulvid | 252/158 |
| 3,997,450 | 12/1976 | Steinmiller | 252/8.9 |
| 4,134,839 | 1/1979 | Marshall | 252/8.9 |
| 4,169,061 | 9/1979 | Carver et al. | 252/8.9 |
| 4,252,528 | 2/1981 | Decker et al. | 252/8.9 |
| 4,343,616 | 8/1982 | Decker et al. | 252/8.9 |
| 4,356,219 | 10/1982 | Boon et al. | 252/8.9 |
| 4,397,985 | 8/1983 | Marshall et al. | 252/8.9 |
| 4,442,249 | 4/1984 | Lees et al. | 252/8.9 |
| 4,552,671 | 11/1985 | Ogiso et al. | 252/8.9 |
| 4,561,987 | 12/1985 | Yamamoto et al. | 252/8.9 |

*Primary Examiner*—Paul Lieberman
*Assistant Examiner*—Willie J. Thompson
*Attorney, Agent, or Firm*—Forrest D. Stine

[57] ABSTRACT

The invention provides partially oriented polyester yarn finishes capable of substantially reducing the level of broken filaments resulting from polyester yarn texturing. Finishes of the invention are a stable oil-in-water emulsion with the oil phase including a polyester yarn texturing lubricant. The emulsion finish has a pH of at least 9.0, preferably between about 10 and about 11.5.

29 Claims, No Drawings

PARTIALLY ORIENTED POLYESTER YARN EMULSION FINISH WITH ELEVATED PH

BACKGROUND OF THE INVENTION

The invention relates to a finish for partially oriented polyester yarn. More specifically, the invention relates to a finish which enables texturing of partially oriented polyester yarn with a substantial decrease in broken filament levels in the resultant textured yarn. Additionally, the invention provides improved finishes for polyester yarns which are compatible with polyurethane texturing element and which minimize broken filament levels in the textured yarn.

False twist texturing of partially oriented polyester yarns involves heating of the yarns by means of a heater tube or plate and subsequently twisting the yarn by means of a friction disc, belt or spindle. Lubricating finishes are typically applied to the yarn prior to the texturing operation in order to prevent filament breakage and other damage to the yarn during texturing.

Broken filament levels are controlled by fiber-to-fiber friction at low speed. Normally this friction is reduced by viscous or solid lubricants with recognized "boundary lubricant" properties. For example, sodium stearate, isostearate or other high viscosity lubricants can be used to reduce broken filament levels. When texturing is conducted by means of elastomeric friction elements, e.g. polyurethane or polyacrylonitrile discs, or polyacrylonitrile/polybutadiene belts, as opposed to "hard" texturing elements such as ceramic discs, it is important that the finish not cause excessive wear of the elastomeric surface. Such excessive wear of elastomeric discs or belts can be attributed to impregnation of fiber finish into the disc or belt and/or chemical attack on the disc or belt surface by the fiber finish.

Though texturing finishes have been developed in recent years which have drastically reduced the amount of broken filaments, broken filaments are found in the textured yarns in measurable amounts and finishes capable of still further reducing the broken filament level would be highly desirable. Further, finishes capable of reducing broken filament levels while not increasing the propensity of the finish to degrade elastomeric texturing elements would likewise be highly desirable.

SUMMARY OF THE INVENTION

The foregoing and other objects are achieved by partially oriented polyester yarn finishes of the invention. In one embodiment of the invention, partially oriented polyester yarn finishes capable of substantially reducing the level of broken filaments resulting from texturing are provided wherein the finish is a stable oil-in-water emulsion with the oil phase constituting between about 2 and about 25 weight percent of the emulsion. The oil phase comprises a polyester yarn texturing lubricant and may also include conventional additives such as emulsifiers, antioxidants and the like. It has been found that by providing the emulsion at a pH of at least 9.0, preferably between about 10 and about 11.5, the texturing performance of yarns bearing the finish is drastically improved. Surprisingly, it has been found that finishes of the invention permanently increase the slickness of the fiber surface, that is, when the finish of the invention is removed from a partially oriented polyester yarn, and the slickness of the fiber surface thereafter measured, the slickness is greater than partially oriented polyester yarn surfaces which have been treated with conventional finishes, followed by removal of the finishes.

In another aspect of the invention an elastomeric texturing element compatible finish for partially oriented polyester yarn is provided. The finish is a stable oil-in-water emulsion with the oil phase constituting between about 2 and about 25 weight percent of the emulsion. The oil phase comprises a polyester yarn texturing lubricant. Additionally, the oil phase has a low, i.e., minimal, elastomeric texturing element degradation propensity which is achieved by careful formulation of the oil phase to avoid substantial inclusion of elastomer-degrading components. The emulsion has a substantially stable pH of at least 9.0, preferably between about 10 and about 11.5.

In still another aspect of the invention, a finish for a multilobal, e.g., hexalobal, octalobal, etc., cross-section partially oriented polyester yarn is provided. The finish is a stable oil-in-water emulsion with the oil phase constituting between about 2 and about 25 weight percent of the emulsion. The oil phase comprises a polyester yarn texturing lubricant and additionally includes greater than about 10 percent by weight of a di-alkyl end capped low molecular weight alkylene oxide, e.g., ethylene oxide/propylene oxide, copolymer wherein the alkyl end groups are linked to the alkylene oxide groups by ether linkages. Additionally, the components of the oil phase are substantially non-hydrolyzable. In this regard, such components contain substantially no ester linkages. The emulsion has a pH of at least 9.0, preferably from about 10.0 to about 11.5.

DETAILED DESCRIPTION OF THE INVENTION

The invention is applicable to finishes for polyester partially oriented yarns. The term polyester is used herein to mean a synthetic, fiber forming linear polyester which typically will be polyethylene terephthalate but may also include other polyesters which are capable of forming partially oriented filament yarns such as polybutylene terephthalate or copolyesters of the same, copolyesters of polyethylene terephthalate, and the like.

In accordance with a first embodiment of the invention, it has been found that conventional oil-in-water emulsion finishes for polyester partially oriented yarn can be greatly improved simply by raising the pH of the finish to a pH of at least 9.0, preferably in the range of between about 10 and about 11.5. Although pH adjustments to an even higher level further improve results, pHs in excess of 11.5 may result in equipment corrosion and/or require increased worker protection, and the like. In order that the finish have a stable pH, buffering agents such as sodium carbonate, sodium bicarbonate, potassium carbonate, potassium bicarbonate and the like are used to increase the pH of the emulsion. Buffering agents are known to those skilled in the art and form no part of the invention. Other buffering agents capable of providing a stable pH in the range of 10 to 11.5 as are known to those skilled in the art can be used in the invention.

Preferred finishes according to the invention will have a pH of between about 10 and about 11 and finishes having a pH of between about 10 and 10.5 are even more preferred. Finishes having a pH of about 10 are particularly preferred since equipment corrosion problems and the like are minimized.

Conventionally polyester partially oriented yarn finishes which can be improved in accordance with the invention are those which are an oil-in-water emulsion wherein the oil phase comprises a polyester yarn texturing lubricant. Typically, the oil phase additionally includes an emulsifier and an antioxidant and may also include other functional agents, such as antistatic agents.

Polyester texturing lubricants are known to those skilled in the art and included: mineral oils, alkyl esters, glycerides, silicone oils, waxes, paraffins, naphthenic and polyolephinic lubricants, polyalkylene glycols, polyoxyalkylene glycols, hindered glycol esters, polyglycol esters ethylene oxide/propylene oxide copolymers and the like.

Preferably the texturing lubricant will contain at most, only a small amount of hydrolyzable component. Otherwise, the pH of the finish can decrease due to hydrolysis of the lubricant. It is believed that the alkylene components of the finish actually modify the surface of the polyester fiber by hydrolysis to form low molecular weight polyester oligomers. If substantial amounts of hydrolyzable components are present in the finish, then the alkali can be consumed by the reaction with such hydrolyzable components and will not be available to modify the surface of the polyester yarn. Thus, the use of ester type lubricants should be minimized or avoided entirely since esters are hydrolyzable. In this regard, it is preferred that there be no more than $10\times10^{-4}$ equivalents of ester groups per gram in the oil phase of the finish. Even more preferably, there will be less than $5\times10^{-4}$ equivalents of ester groups per gram in the oil phase of the finish. Equivalents per gram is calculated for each ester component by dividing the weight of the ester component, per gram of oil phase, by the molecular weight of the ester and multiplying by the number of ester groups per molecule, i.e., (no. of ester groups per molecule)×(weight of ester compound per gram of oil)÷(molecular weight of ester compound).

Emulsifiers which are typically included in partially oriented polyester yarn texturing finishes include soaps of alkali, alkaline earths and amines, glycerol mono-difatty acids esters, sorbitan and polyoxyethylene sorbitan esters, polyglycerol esters, polyoxyethylene esters, polyoxyethylene ethers, polyoxyethylene polyol ether esters, polyoxyethylene amines and amides, partial polyol ester ethoxylates, sulfated vegetable oils, sulfonated aromatic petroleum hydrocarbons, and the like.

Choice of emulsifier can be particularly important in this invention. For example, the emulsifier must be minimally susceptible to hydrolysis, or preferably nonhydrolyzable. Furthermore, as discussed hereafter, various emulsifiers have a strong propensity to attack polyurethane texturing elements and where a polyurethane texturing element compatible finish of the invention is prepared, choice of emulsifier can be critical. The finish will advantageously also include one or more antioxidants compositions which can assist in maintenance of clean heater plates. The amount of antioxidant used will depend upon the nature of the particular antioxidant. Thus, with some known antioxidants an amount of up to 3 percent by weight, based on the weight of the oil, may be needed. Preferred antioxidants are those which donate a neutral hydrogen atom, for example, the hindered phenols or secondary aromatic amines. Such antioxidants are preferably used in an amount of less than about 1 weight percent and it is especially preferred that they be used in synergistic combination with a reducing antioxidant such as a phosphite or hypophosphite. When such a synergistic combination is used, an amount of about 0.25 weight percent, each, of hindered phenol or secondary aromatic amine, and phosphite or hypophosphite, will be sufficient. If desired, the finish can include minor amounts of other materials, e.g. viscosity adjusting agents, surface tension adjusting agents, biocides, and the like.

The oily phase of the finish is emulsifiable and capable of forming a stable emulsion with water. By the term "stable emulsion" it is meant that the emulsion is stable at the time of application of the emulsion finish to the yarn surface. This is meant to include oil-in-water finishes which may be mixed just prior to their application to the yarn surface and which may be stable only under conditions of mixing and application. In this regard, such an application system is disclosed in U.S. Pat. No. 4,431,684 to Strohmaier which is hereby incorporated by reference. Typically, however, the finish will be mixed well prior to yarn application and then applied via various applicators from a storage tank or the like and thus the emulsion must be stable for extended time periods.

The oil phase of the emulsion will constitute between about 2 and about 25 weight percent of the emulsion, preferably between about 5 and about 25 weight percent of the emulsion, most preferably between about 5 and about 10 weight percent of the emulsion. Emulsions having a high oil content, i.e., an oil content in excess of greater than about 10 weight percent of the emulsion are not preferred. High percentage oil mixtures often form a stable, liquid emulsion only with difficulty. Additionally, as an emulsion finish is applied to yarn to provide to given weight percent oil on yarn, (typically between about 0.1 and about 1 percent by weight, preferably between about 0.3 and about 0.5 percent by weight, oil on yarn), where high oil content emulsions are used, less finish will be applied to the yarn. This in turn results in the application of less alkali to the yarn which can result in a lesser degree of surface modification on the yarn.

Thus, where high oil content emulsions are to be used, it can be advantageous to use a higher pH finish and/or include amounts of buffering agents in excess of that required to stabilize the pH of the emulsion at the desired pH. Conversely, where low oil content emulsions are used, the amount of buffering agent used can be the minimum required to stabilize the emulsion pH at the desired pH of at least 9.0, preferably between about 10 and about 11.5.

It has been found that polyester partially oriented yarns treated with finishes of the invention have a permanently slicker surface than polyester partially oriented yarns treated with a conventional finish (which have a pH of less than 8.5, typically 8.0). This can be shown by preparing identical polyester partially oriented yarn samples wherein one is treated with a conventional partially oriented polyester yarn finish and the second yarn is treated with the same finish which has been modified to increase its pH to between about 10.0 and 11.5. The two yarn samples are then stored for one to two weeks at ambient conditions and the finish is removed from each yarn by washing with warm water. The yarns are then dried and tested by means of the following test.

A weight is suspended from one end of the yarn wherein the mass of the weight is equal to 0.1 gram multiplied by the total denier of the yarn. The yarn is passed across a roller and is then passed downwardly and around a measuring head located below and a small lateral distance from thr first roller. The yarn is then passed back upwardly and is wrapped around itself three times and is then passed around a third roll located laterally from, and at substantially the same height as the first roll and is then passed to a wind-up device. Such apparatus will be known to those skilled in the art and is illustrated in, for example, FIG. 2 of U.S. Pat. No. 4,053,678 to Betz et al, which is hereby incorporated by reference. The yarn is then pulled at a speed of 0.1 centimeters per minute and the tension reading from the tension head is continuously recorded. It will be found that initial tension will be equal to the mass of the counterweight and that the tension will gradually build up until the yarn slips across itself, at which point the recorded tension will decrease to the original value. The difference between the initial tension and the tension at which the yarn begins to slip is a measure of the slickness of the yarn surface. Test conducted on yarns described above will demonstrate that washed yarns previously treated with finishes of this invention will actually require lower tensions for the yarn to slip across itself when compared to the same washed yarn previously treated with the conventional finish.

In one preferred embodiment of this invention, elastomeric texturing element compatible finishes are provided. Such finishes in addition to the above described characteristics must have a low elastomeric element degradation propensity. By this, it is meant that the oily components of the finish have a low propensity to swell and/or chemically attack elastomeric texturing elements.

A convenient method for determining the propensity of a finish to degrade polyurethane texturing elements involves testing a small piece of a polyurethane texturing disc in the oil phase of the finish according to the following or a similar procedure. A Disogrin D-80 polyurethane texturing disc (manufactured by DISGORIN INDUSTRIES, CORP.), or its equivalent is obtained. The Disogrin D-80 is a polyester based urethane, determined from chemical analysis, to be the reaction product of polycaprolactone and tolidine diisocyanate. The disc has a Shore Hardness of about 80. A portion of the disc, i.e., having a weight of between 0.1 to several grams, is removed by cutting and weighed. The urethane disc sample is then submerged in the oil phase of the finish for six hours at 130° C. The urethane sample is removed from the finish and the weight gain is measured. If the urethane has gained more than 10 percent by weight, based on the weight of the urethane sample, the finish will not be urethane compatible. Preferably, urethane compatible finishes will cause the urethane sample to gain less than 7 percent by weight, most preferably less than or equal to 5 percent by weight, based on the weight of the urethane sample. The surface of the polyurethane sample is also examined to determine whether the surface has become cracked, degraded and discolored, usually to a whitish color. If surface degradation is so severe that the surface has become gummy and can be easily scraped away with a sharp object such as a paper clip or fingernail, then the finish is not polyurethane compatible. Where compatibility with a different elastomer such as polyacrylonitrile or polyacrylonitrile/polybutadiene, is desired, the same or a similar test is used but substituting the different elastomer.

Additionally, it should be noted that elastomer compatibility is a matter of degree. In this regard, whereas a finish may be compatible for polyurethane when used on a low denier yarn, i.e., having a total denier of about 110 and which is to be textured at a relatively low tension, the same finish may not be polyurethane compatible when used on a high denier yarn, i.e., having a denier of greater than about 150, and which is to be textured at higher tensions. Thus, in cases where a finish is to be used on a higher denier yarn, it may be necessary to improve polyurethane compatibility by modifying the composition of the finish to include lesser amounts of components harmful to polyurethane texturing elements. In such instances components which degrade the polyurethane surface are particularly to be avoided. However, with very high denier, high tension texturing feedstocks, it has been found that the alkali, itself, appears to degrade the some urethane surfaces and in such cases, use of the instant invention may be appropriate only with a pH of about 9.0 or may not be appropriate at all. For the purposes of this invention, finishes which pass the test described above with respect to the particular elastomer to be used in texturing, are considered to be elastomer compatible.

As regards polyurethane disc compatibility of various finish composition components, the following general rules typically apply. Within a series of closely related compounds, the polyurethane degradation propensity of the compounds will decrease with increasing molecular weight. Additionally, it has been found that materials such as ethyoxylated long chain alcohols and acids appear to have high degradation propensity. Random ethylene/propylene oxide copolymers of low molecular weight and polypropylene glycols of low molecular weight degrade urethane discs to an intermediate extent. Materials like block ethylene oxide/propylene oxide copolymers, ester lubricants, branched chain ethyoxylates, polyethylene glycols, branched polypropylene glycol, hydrocarbons, phosphate esters and silicones tend to give medium to low polyurethane degradation propensity. The same or similar rules will apply with respect to other elastomers.

In another aspect of the invention, a texturing finish for a multi-lobal, e.g., hexalobal, octalobal, and the like, cross-section partially oriented polyester yarn is provided. It has been found that it is particularly difficult to provide high lubricating finishes for such multiple-lobal cross-section yarns. This is believed to be due to several factors. In a yarn composed of multiple-lobal cross-section filaments, the surface area of contact between the filament is lower. That is, predominantly the contact will take place at the ends or tips of lobes. Therefore, the load or contact force per unit of surface area is substantially higher. Filament to filament contact with such yarns can be analogized to the action of a threaded tire on a rain covered road. The threaded tire cuts through the liquid layer (which in the case of a yarn bearing a finish corresponds to the finish) and gives a better grip. The latter corresponds to a higher load or friction on the yarn surface.

In connection with such multi-lobal yarns, it has been found that simply increasing the pH of an emulsion finish to greater than about 9.0, or even 10, does not adequately decrease broken filament levels in texturing. While an adequate decrease in broken filament levels can be observed at pHs in excess of 11.5, such pHs are so high that equipment corrosion can result and increased worker protection may be required. In accordance with the invention, it has been found that improved finishes for such yarns can be provided wherein the finish emulsion has a pH of greater than about 9.0, preferably between about 10 and 11.5; the components of the oil phase are substantially totally non-hydrolyzable by the alkali or alkylene buffering agent used to raise the pH; and the oil phase includes at least about 10 percent by weight of a di-alkyl end capped low molecular weight alkylene oxide, e.g., ethylene oxide/propylene oxide, copolymer wherein the alkyl end groups are linked to the ethylene oxide/propylene oxide groups by ether linkages. A preferred di-alkyl end capped ethylene oxide/propylene oxide copolymer for use in this aspect of the invention has the formula: $C_{13}H_{27}O(EO)_4(PO)_3C_4H_9$, wherein EO represents an ethylene oxide moiety and PO represents a propylene oxide moiety, as will be understood by those skilled in the art. Other substantially equivalent end capped ethylene oxide/propylene oxide copolymers can also be used. Thus, larger or smaller alkyl groups can be substituted for the alkyl groups on either end of the molecule. The number of ethylene oxide and propylene oxide groups can be decreased or increased substantially. Moreover, the ratio of ethylene oxide to propylene oxide groups can also be increased or decreased; however, it will be understood by those skilled in the art that changing such ratio will also change the affinity of the compound for aqueous media and may require modifications for the overall composition in order that the composition be emulsifiable.

Advantageously, the di-alkyl end capped alkylene oxide copolymer will comprise between about 10 and about 30 weight percent of the oil phase of the finish. More advantageously, such compound will comprise from about 15 to about 25 percent, by weight of the oil phase of the finish. It is further advantageous that a major portion of the remaining lubricant comprise a high molecular weight ethylene oxide/propylene oxide copolymer; for example, between about 40 to about 60 weight percent of the oil phase can comprise an ethylene oxide/propylene oxide copolymer having a molecular weight of greater than about 1,000, preferably 1200 to 1500. The oil phase additionally advantageously has a low viscosity. And viscosity adjusting agents, such as low viscosity mineral oils can be added in order to lower the viscosity of the oil phase.

Emulsifiers, either or both, non-ionic and ionic, may be required in substantial amounts in order to promote emulsification of the mixture when hydrophobic components such as those discussed above are used.

As indicated previously, yarns which have been treated with finishes of the invention, i.e. yarns bearing the residue of finishes of the invention have modified surfaces which provide advantageous enhancements in connection with the texturing of the yarns of the invention. The following examples serve to further illustrate the invention and its various aspects and to set forth the best mode contemplated for carrying out the invention.

EXAMPLE I

Polyurethane compatible finishes were prepared. One finish was a control finish having a pH of 8.2 the other was a finish of the invention with the same components as the control finish except that the finish of the invention contained alkaline buffering agents (set forth below) sufficient to raise the pH of the finish to 10.0.

| Control Finish | |
|---|---|
| Percent By Weight | Component |
| 53.0 | 10/90 ethylene oxide/propylene oxide block copolymer having a molecular weight of 1100 |
| 4.0 | Polyoxyethylene (6) tridecyl alcohol |
| 8.0 | Isostearic Acid |
| 15.0 | Isobutyl Stearate |
| 20.0 | 10/90 ethylene oxide/propylene oxide block copolymer having a molecular weight of 2750 |
| 0.25 owo* | Antioxidant |
| 0.25 owo* | Antioxidant |
| 0.15 owo* | Fluorocarbons marketed by 3M Corp. as Zonyl (surface tension reducing agents, one is water soluble, the other oil soluble) |
| 0.15 owo* | |
| 2.25* | 45 weight percent aqueous potassium hydroxide solution |

*On Weight of Oil. These components were added as a percentage by weight, based on the weight of the first five listed oil components.

The ingredients above were mixed with agitation, with sufficient water to form a 5.5 percent by weight oil-in-water emulsion. The high pH finish of the invention was prepared by adding to the 5.5 percent emulsion the following:

| Percent By Weight | Component |
|---|---|
| 1.0 | 14 weight percent aqueous solution of sodium carbonate |
| 1.0 | 4.0 weight percent aqueous solution of sodium bicarbonate |

Polyethylene terephthalate yarns composed of 33 filaments and having a total denier of 108 were prepared by melt spinning on the same machine at the same time. The control finish was applied to one threadline to provide 0.30 percent by weight, finish on yarn. To the other threadline was applied the high pH finish in the same amount. The yarns were then textured at standard conditions and the textured yarn packages were stored 24 hours at 70° C. and at 40 percent relative humidity. The slickness of the yarn surfaces were then measured according to the test described earlier wherein the mass of the weight applied to each yarn sample was 15 grams. The tensions required, above the baseline tension, in order to cause the yarns to slip across itself in each case are set forth below:

| Finish | Tension (grams) |
|---|---|
| Control | 4.82 |
| High pH | 2.31 |

It can be seen that yarns treated with finishes of the invention and then textured have remarkably slicker surfaces than yarns treated with finishes having the customary, substantially neutral pH. Additionally, it is to be noted that the tension differences found according to this test, based on different finishes are typically more apparent when the test is conducted with texturing feed yarns (polyester POY). However, POY yarn packages were simply not available at the time of this test. Nevertheless, the surface slickness of the yarn samples were radically different.

EXAMPLE II

Polyester partially oriented yarn finishes were prepared. One finish was a control finish having a pH of 8.2. The other finish was prepared from the same components with the addition of buffering agents sufficient to raise the pH to 11.5. The control finish had the following components in the oil phase:

| Percent By Weight | Component |
|---|---|
| 81.7 | 10/90 ethylene oxide/propylene oxide block copolymer having a molecular weight of 1100 |
| 3.3 | Hexyl phosphate potassium salt |
| 5.0 | Isostearic Acid |
| 10.0 | Ethylene oxide dimethyl polysiloxane (Ucarsil L.7602 supplied by Union Carbide Corp. USA) |

A high pH emulsion finish of the invention was prepared from the same components listed above together with the following components:

| Percent By Weight | Component |
|---|---|
| 1.0 | Potassium hydroxide (added as a 10% aqueous solution) |
| 0.5 | Polyamylamide/sodium acrylate (Nalco 2332 supplied by Nalco Chemical Co.) |

Samples of polyethylene terephthalate octalobal cross-section yarn having 48 filaments and a total denier of 230 were prepared at the same time. To one sample was applied a spin finish which was the control finish described above. To the second sample was applied the high pH finish described above. The yarns were textured using conventional equipment and conventional conditions. The yarn surfaces were then washed with dioxane and the resultant solution was analyzed to determine the percentage by weight, based on yarn weight, of surface oligomer. The following results were obtained:

| Finish Used On Yarn | Percent Surface Oligomer |
|---|---|
| High pH Finish | 0.0365 |
| Conventional pH Finish | 0.0295 |

It is seen that a high pH (pH 11.5) increases surface oligomer over a conventional pH finish (pH 8.2) by a factor of about 20 percent. It is believed that the increased oligomeric surface is at least in part responsible for improved texturing performances resulting from use of finishes of the invention.

EXAMPLE III

This example illustrates preparation of a finish for multi-lobal cross-section yarns. The finish is intended for use in hard disk texturing processes. The finish was prepared from the following components:

| Percent By Weight | Component |
|---|---|
| 21.0 | UCON 50HM 100 (Union Carbide Corp.) by analysis $C_{13}H_{27}O(EO)_4(PO)_3C_4H_9$ wherein the ethylene oxide/propylene oxide groups are in random, not blocked, form. |
| 47.0 | 50/50 ethylene oxide/propylene oxide block copolymer having a molecular weight of 1900 |
| 8.0 | Tergitol - D683 (Union Carbide Corp. USA) an emulsion believed to be, based on analysis, an ethylene oxide/propylene oxide nonyl phenol |
| 10.0 | TERGITOL 1553 (Union Carbide Corporation) - polyoxyethylene(3) $C_{11}$-$C_{15}$ secondary alcohol |
| 1.0 | Hexyl phosphate potassium salt |
| 2.0 | Ethoxylated polysiloxane, (see Example II for structure, etc.) |
| 5.0 | Isostearic acid |
| 1.0 | 75/25 ethylene oxide/propylene oxide copolymer having a viscosity of about 9500 SUS (UCON 75H 9500 supplied by Union Carbide Corporation USA) |
| 5.0 | Low viscosity (55 SUS) mineral oil |
| 0.25 owo* | Antioxidant |
| 0.25 owo* | Antioxidant |
| 10.0 owo* | 10 weight percent aqueous potassium hydroxide solution |

*These ingredients are added in a weight percent which is based on the weight of the first nine oily components.

The above materials are mixed with sufficient water to provide a 6.0 percent by weight oil-in-water emulsion. Sufficient aqueous sodium carbonate and sodium bicarbonate are added in the same relative amounts (relative to each other) as in Example I to raise and stabilize the pH of the finish at 10.0.

When the finish was applied to polyethylene terephthalate octalobal cross-section yarn having 48 filaments and a total denier of 230, and the resultant yarn textured using conventional hard disk equipment at conventional conditions, it was found that fray count was drastically reduced compared to conventional texturing finishes when applied to the same yarn and textured under the same conditions. With a conventional finish, fray count was in excess of 200. With the finish of this example but having a pH of 8.2, fray count was 28. With the finish of this example having a pH of 10, the fray count was 12. Fray count is measured electronically, by optics. It is also to be noted that substitution of another conventional lubricant including ethylene oxide/propylene oxide copolymers for the first listed component of this finish resulted in a finish which did not adequetely improve the texturing performance of the octalobal cross-section polyester yarn, even though pH was increased to above 9.0. Without the first component, the pH increase appeared to adequately improve the performance of the finish only when the pH was raised to an objectionably high level of above 11.5.

EXAMPLE IV

Finishes were prepared from the same components as in Example I and Example III. In each case the finish was provided at a low pH and at a high pH. Additionally, a conventional ester-based finish was provided both at a low and at a high pH. The finishes were applied to polyethylene terephthalate yarns of substantially round cross-section having a total denier of 108 and 33 filaments. The yarns were textured on a BARMAG M-700 texturing apparatus at the conditions described below. After texturing, various properties of the textured yarns were measured. The results are set forth below.

| FINISH | pH | ESTER GROUPS equivalents per gram $\times 10^{-4}$ | BROKEN FILAMENTS PER POUND[1] | FRAY COUNT A[2] B[3] C[4] | LOOPS/ POUNDS[1] |
|---|---|---|---|---|---|
| Ex. 3 | 9.0 | 0 | NM[5] | A 2.8<br>B 15.5<br>C 19.5 | NM |
| Ex. 3 | 10.0 | 0 | 0.08 | A 0.5<br>B 1.8<br>C 9.5 | 0.15 |
| Ex. 1 | 8.5 | 4.4 | 0.86 | A NM<br>B NM<br>C NM | 0.45 |
| Ex. 1 | 10.0 | 4.4 | 0.13 | A NM<br>B NM<br>C NM | 0.10 |
| Conv. Ester Containing Finish | 8.5 | 8.75 | NM | A 1.0<br>B 2.5<br>C 19.5 | NM |
| Ester Based Finish | 10.0 | 8.75 | NM | A 0.5<br>B 3.5<br>C 13.5 | NM |

[1]Speed was 600 meters per minute, primary heater temperature was 205° C.
[2]Speed was 600 meters per minute, primary heater temperature was 200° C.
[3]Speed was 600 meters per minute, primary heater temperature was 215° C.
[4]Speed was 900 meters per minute, primary heater temperature was 215° C.
[5]Not Measured Broken filaments per pound was determined visually by inspecting POY package surfaces. Fray count is determined electronically by optics and is proportional to broken filaments per pound.

The three types of finishes used in this example are representative of the various types of finishes which are conventionally used for texturing of partially oriented polyester yarn. It can be seen that in each case, increasing the pH of the finish substantially improved texturing of the yarns bearing the finish. It will also be noted that the relative increase in texturing performance, comparing a conventional finish to a high pH finish, was not as pronounced with finishes containing greater amounts of hydrolyzable esters. Thus, the invention is best practiced with only low amounts of hydrolyzable components in the finish. However, in accordance with the practice of the invention, this could be overcome somewhat by including excess amounts of buffering agents in the finish.

The invention has been described in considerable detail with specific reference to preferred embodiments thereof. But modifications and variations can be made within the spirit of the invention and without departing from the scope of the appended claims.

What is claimed is:

1. A partially oriented polyester yarn finish capable of substantially reducing the level of broken filaments resulting from texturing wherein the finish is a stable oil-in-water emulsion with the oil phase constituting between about 2 and about 25 weight percent of the emulsion, the oil phase comprising a polyester yarn texturing lubricant and wherein the emulsion finish has a pH at least 10.

2. The partially oriented polyester yarn finish defined in claim 1 wherein the pH of the emulsion finish is in the range of between about 10 and about 11.5.

3. The partially oriented polyester yarn finish defined in claim 2 wherein the emulsion finish has a substantially stable pH in the range of between about 10 and about 11.

4. The partially oriented polyester yarn finish defined in claim 3 wherein the emulsion finish has a stable pH in the range of between a about 10 and about 10.5.

5. The partially oriented polyester yarn finish defined in claim 1 which additionally comprises 1 or more buffering agents.

6. The partially oriented polyester yarn finish defined in claim 1 wherein the oil phase of the finish does not contain substantial amounts of hydrolyzable components.

7. The partially oriented polyester yarn finish defined in claim 6 wherein the oil phase of the finish contains less than $10\times 10^{-4}$ equivalents of ester groups per gram of oil phase.

8. The partially oriented polyester yarn finish defined in claim 7 wherein the oil phase of the finish contains less than $5\times 10^{-4}$ equivalents of ester groups per gram of oil.

9. The partially oriented polyester yarn finish defined in claim 1 wherein the oil phase of the emulsion finish constitutes between about 2 and about 25 weight percent of the emulsion.

10. The partially oriented polyester yarn finish defined in claim 9 wherein the oil phase of the emulsion finish constitutes between about 5 and about 25 weight percent of the emulsion.

11. The partially oriented polyester yarn finish defined in claim 10 wherein the oil phase of the emulsion finish constitutes between about 5 and about 10 weight percent of the emulsion.

12. A partially oriented polyester yarn bearing thereon from 0.1 to 1.0 percent by weight of the oil as the residue of the finish defined in claim 1.

13. The partially oriented polyester yarn bearing thereon from 0.1 to 1.0 percent by weight of the oil as the residue of the finish defined in claim 4.

14. The partially oriented polyester yarn bearing thereon from 0.1 to 1.0 percent by weight of the oil as the residue of the finish defined in claim 7.

15. The partially oriented polyester yarn bearing thereon from 0.1 to 1.0 percent by weight of the oil as the residue of the finish defined in claim 10.

16. The partially oriented polyester yarn defined in claim 12 wherein said polyesters is polyethylene terephthalate.

17. The partially oriented polyester yarn defined in claim 3 wherein said polyester is polyethylene terephthalate.

18. The partially oriented polyester yarn defined in claim 14 wherein said polyester is polyethylene terephthalate.

19. An elastomeric texturing element compatible finish for partially oriented polyester yarn which is a stable oil-in-water emulsion with the oil phase constituting between about 2 and about 25 weight percent of the emulsion, the oil phase comprising a polyester yarn texturing lubricant, said oil phase having a low elastomeric texturing element degradation propensity, said emulsion finish having a substantially pH of at least 10.

20. The partially oriented polyester yarn finish defined in claim 19 wherein said emulsion finish has a stable pH of between about 10 and about 11.5.

21. The partially oriented polyester yarn finish defined in claim 20 wherein said emulsion has a substantially stable pH of between about 10 and about 10.5.

22. The partially oriented polyester yarn finish defined in claim 20 wherein said oil phase contains less than about $5\times10^{-4}$ equivalents of ester groups per gram in the oil phase.

23. The partially oriented polyester yarn finish defined in claim 21 wherein the oil phase of said emulsion finish comprises less than about $5\times10^{-4}$ equivalents of ester groups per gram.

24. The partially oriented polyester.ester yarn finish defined in claim 20 wherein said finish is polyurethane compatible.

25. The partially oriented polyester yarn finish defined in claim 21 wherein said finish is polyurethane compatible.

26. A finish for a multi-lobal cross-section partially oriented polyester yarn which is a stable oil-in-water emulsion with the oil phase constituting between about 2 and about 25 weight percent of the emulsion, said oil phase comprising a polyester yarn texturing lubricant and additionally including greater than about 10 percent by weight, based on the weight of the oil phase, of a di-alkyl end capped low molecular weight ethylene oxide/propylene oxide copolymer wherein the alkyl end groups are linked to the alkylene oxide groups by ether linkages, said emulsion finish having a stable pH of at least about 10.

27. The partially oriented polyester yarn finish defined in claim 26 wherein said emulsion finish has a pH of between about 10 and about 10.5.

28. The partially oriented polyester yarn finish defined in claim 27 wherein said emulsion finish has a pH of between about 10 and 10.5.

29. The partially oriented polyester yarn finish defined in claim 26 wherein a major portion of the oil phase of said emulsion finish is composed of an ethylene oxide/propylene oxide copolymer having a molecular weight greater than about 1000 and wherein the components of said oil phase are substantially totally non-hydrolyzable by the alkaline components present in said emulsion finish.

* * * * *